United States Patent [19]

Ormrod

[11] 3,963,934

[45] June 15, 1976

[54] TRITIUM TARGET FOR NEUTRON SOURCE

[75] Inventor: John H. Ormrod, Deep River, Canada

[73] Assignee: Atomic Energy of Canada Limited, Ottawa, Canada

[22] Filed: Nov. 20, 1974

[21] Appl. No.: 525,515

Related U.S. Application Data

[63] Continuation-in-part of Ser. No. 340,336, March 12, 1973, abandoned.

[30] Foreign Application Priority Data

May 16, 1972 Canada ..... 142273

[52] U.S. Cl. ..... 250/499

[51] Int. Cl.[2] ..... G21G 4/02

[58] Field of Search ..... 250/499, 500, 501, 502; 313/61 S

[56] References Cited

UNITED STATES PATENTS 3,766,389 10/1973 Fabian ..... 250/499

*Primary Examiner*—Davis L. Willis

*Attorney, Agent, or Firm*—James R. Hughes

[57] ABSTRACT

A tritium target for a neutron source that comprises a target layer of tritiated titanium sandwiched between layers of aluminum oxide which act to inhibit diffusion of tritium out of the target layer, a layer of aluminum on the front or beam side of said target to act as a sputter shield, a metallic backing layer behind the target, and cooling means adjacent the backing layer for cooling the said target and absorbing and diffusing stopped deuterons.

5 Claims, 1 Drawing Figure

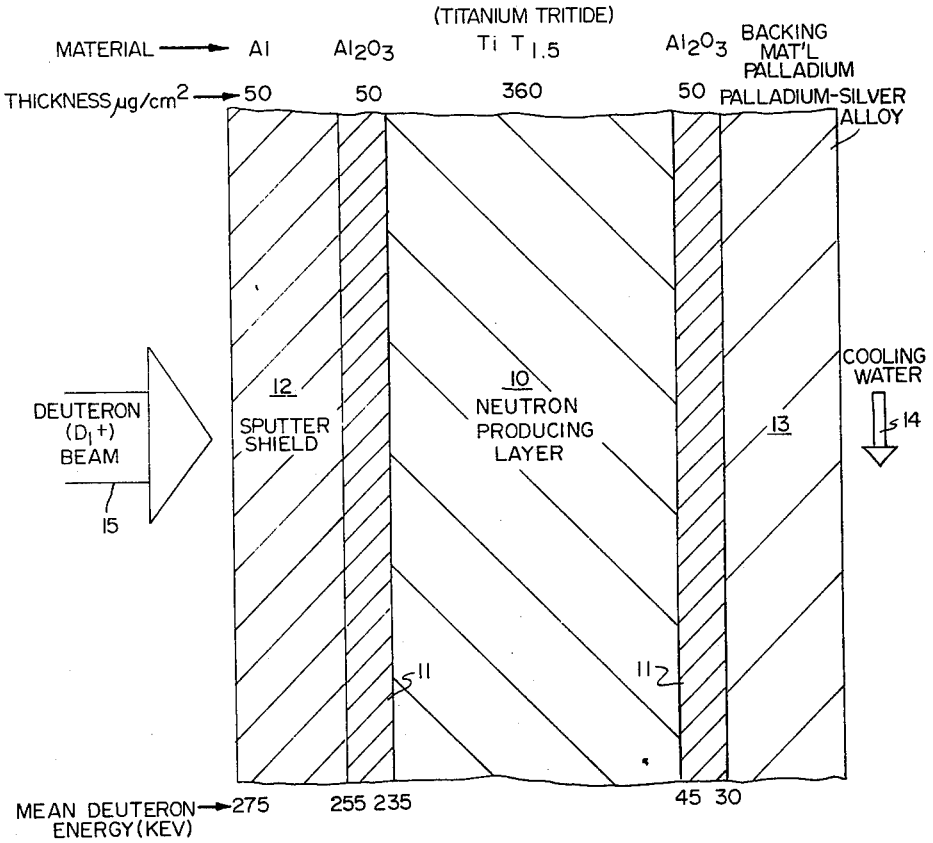
(TITANIUM TRITIDE)
MATERIAL
Al
$Al_2O_3$
Ti $T_{1.5}$
$Al_2O_3$
BACKING MAT'L PALLADIUM
THICKNESS μg/cm²
50
50
360
50
PALLADIUM-SILVER ALLOY
COOLING WATER
DEUTERON ($D_1$+) BEAM
12
SPUTTER SHIELD
10
NEUTRON PRODUCING LAYER
13
14
15
11
11
MEAN DEUTERON ENERGY (KEV)
275
255 235
45 30

TRITIUM TARGET FOR NEUTRON SOURCE

This application is a continuation-in-part of application Ser. No. 340,336 filed Mar. 12, 1973 now abandoned.

This invention relates to a neutron source and more particularly to a tritium target which when bombarded with a beam of deuterons produces energetic neutrons.

Energetic neutrons may have advantages over X-rays in the treatment of deep seated anoxic tumors. The exothermic $d(T,He^4)n$ reaction is ideally suited for the production of these neutrons. Not only are the neutrons produced very energetic (~14 MeV) but the reaction has a large cross-section in the hundred kilovolt region. The neutron source strength required for a medical therapy unit is approximately $2 \times 10^{12}$ n/s and the problem in existing machines using tritiated metal targets is the rapid decrease of the neutron production in time, e.g. typical target lifetimes are a few mA-hours/cm$^2$. There is still some doubt about the cause of this decay. One method of overcoming the decreasing neutron production is to continuously regenerate the target by implanting tritium with a mixed deuterium-tritium beam. This requires a considerable quantity of radioactivity in gaseous form with the attendant dangers should breakage occur and, therefore, this approach is not in widespread use.

It is proposed here that implanted deuterons concentration which has a time constant near the experienced lifetimes of the targets is the likely cause of their quick decay. When the hydrogen concentration (both deuterium and tritium) exceed the stoichiometric ratio, bubbles will form in the hydride and will grow until the pressure is sufficient for them to burst into the vacuum region. These bubbles are composed of both deuterium and tritium and may account for the decaying neutron yield.

A neutron-emitting tritiated target is described in British Pat. No. 1,205,359 issued to Commissariat a l'Energie Atomique and dated July 23, 1969. This patent discloses a target in which the tritiated metal layer is applied to a support by way of a thin intermediate metal barrier. The purpose of this metal barrier is to allow deuterons which have passed through the tritiated layer to diffuse towards the support and at the same time prevent the passage of tritium from the layer towards the support. The materials proposed for this barrier are the metals, gold, silver, copper, aluminum, etc. Although this may be an answer to the problem there are indications that a metal barrier will not work efficiently or effectively in this manner. In addition only a single, back layer is used and it is expected that interstitial tritium can escape out the front or beam side of the tritiated layer.

A target for producing meutrons having a layered construction is described in U.S. Pat. No. 3,766,389 issued Oct. 16, 1973 to H. Fabian. This target is made up of a copper plate on which is mounted a titanium hydride layer upon which is an erbium hydride layer. Upon bombardment in the accelerator apparatus, the deuterium is completely stopped in the erbium hydride. The deuterons do not pass through the target but there is an increase in the numbers of these which will lead to the formation of bubbles and degradation of performance.

It is an object of the present invention to provide a tritium target for an ion source that is longer lasting than those in present use.

It is another object of the invention to provide a tritium target that allows transmission of the deuterons through the target layer rather than their stoppage and absorption in this layer.

It is another object of the invention to provide a tritium target that has means for preventing or inhibiting diffusion of deuterons back into the tritiated layer after passage therethrough.

These and other objects of the invention are achieved by a tritium target for a neutron source that comprises a target layer of tritiated titanium sandwiched between layers of aluminum oxide which act to inhibit diffusion of tritium out of the target layer, a layer of aluminum on the front or beam side of said target to act as a sputter shield, a metallic backing layer behind the target, and cooling means adjacent the backing layer for cooling the said target and absorbing and diffusing stopped deuterons.

Referring to the single drawing which shows the various layers and their relative thickness, a central layer 10 of tritiated titanium acts as the neutron producing region. In practice a sub-stoichiometric film of titanium tritide ($TiT_{1.5}$) is used and this can be readily achieved. Higher concentrations of tritium are difficult to obtain. The tritiated titanium layer is sandwiched between or enclosed in a relatively thin barrier layers 11 of non-metallic material. It has been found that aluminum oxide ($Al_2O_3$) is the most effective material for this purpose. It has also been found that yttrium oxide may be used for this purpose. If the beam of deuterons strikes the aluminum oxide layer directly there is a tendency to sputter off portions of this. For this reason a sputter shield 12 to protect this aluminum oxide layer is positioned on the front or beam side of the target and is preferably a relatively thick layer of aluminum. This layer is slowly sputtered away in time but is sufficiently thick to be operative for the expected normal life of the target. A suitable backing or substrate layer 13 of a suitable material e.g. palladium or palladium-silver alloy, is positioned behind the target and permits the stopped deuterons to diffuse into the cooling water 14. These materials have a high diffusion coefficient compared to copper which would be unsuitable for this purpose. Typical layer thicknesses are shown on the diagram (in micro-grams per square centimeter). Representative figures of mean deuteron energy levels (in KeV) from beam 15 into the various layers of the target are shown at the bottom of the diagram.

A beam of approximately 15mA of 275 keV $D_1$ ions striking a $TiT_{1.5}$ target will produce $2 \times 10^{12}$ neutrons/-sec. Conventional targets have been found to be short-lived and inadequate. In the present invention the deuterons pass through the target layers because of their high directional kinetic energy and stop in the palladium or palladium alloy layer. The only way that they can get back through the second $Al_2O_3$ barrier is by diffusion. In fact they diffuse through the palladium into the cooling water.

I claim:

1. A tritium target for use in conjunction with a beam of deuterons to provide a neutron source that comprises a target layer of tritiated titanium sandwiched between first and second layers of a metal oxide which act to inhibit diffusion of tritium out of the target layer and diffusion back into the target of deuterons that have passed therethrough, the said first metal oxide layer being on the beam side of the target layer, a layer of aluminum on the first metal oxide layer to protect the metal oxide layer from sputtering action by direct impingement of the deuteron beam, a metallic backing layer on the second metal oxide layer, said backing layer being of a metal having a high diffusion coefficent, and cooling means adjacent the backing layer for cooling the said target and absorbing and diffusing stopped deuterons.

2. A tritium target as in claim 1 wherein the metal oxide is aluminum oxide.

3. A tritium target as in claim 1 wherein the metal oxide is yttrium oxide.

4. A tritium target as in claim 1 wherein the backing layer is a palladium.

5. A tritium target as in claim 1 wherein the backing layer is palladium-silver alloy.

* * * * *